US012329284B2

(12) United States Patent
Smith et al.

(10) Patent No.: US 12,329,284 B2
(45) Date of Patent: Jun. 17, 2025

(54) ADJUSTABLE BED BASE WITH DECLINE FEATURE ON BOTH ENDS

(71) Applicant: L&P Property Management Company, South Gate, CA (US)

(72) Inventors: Dustin W. Smith, Carthage, MO (US); Isaac T. Freelend, Sarcoxie, MO (US)

(73) Assignee: L&P Property Management Company, South Gate, CA (US)

( * ) Notice: Subject to any disclaimer, the term of this patent is extended or adjusted under 35 U.S.C. 154(b) by 256 days.

(21) Appl. No.: 18/166,076

(22) Filed: Feb. 8, 2023

(65) Prior Publication Data

US 2024/0260759 A1 Aug. 8, 2024

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 20/08
USPC ..... 5/618
See application file for complete search history.

(56) References Cited

U.S. PATENT DOCUMENTS

RE24,762 E * 1/1960 Sellner ..... A47C 20/08 297/320
3,349,877 A * 10/1967 Downs ..... A61G 7/015 477/8
3,636,573 A * 1/1972 Bartz ..... A61G 7/015 5/660
4,685,159 A 8/1987 Oetiker
6,101,647 A * 8/2000 Stroud ..... A47C 20/041 5/915
6,276,011 B1 * 8/2001 Antinori ..... A47C 20/041 5/613
6,499,162 B1 * 12/2002 Lu ..... A47C 20/08 5/616
10,111,530 B1 10/2018 Kramer et al.
2003/0093863 A1 * 5/2003 Grove ..... A61G 7/053 5/618
2004/0064891 A1 * 4/2004 Horitani ..... A47C 20/08 5/618
2012/0240337 A1 * 9/2012 Shih ..... A61G 7/015 5/616
2018/0000283 A1 2/2018 Sherman et al.
2018/0001106 A1 4/2018 Totemeier et al.
2018/0110665 A1 * 4/2018 Totemeier ..... A47C 20/08
2020/0154888 A1 * 5/2020 Brown ..... A47C 20/041
2020/0154899 A1 * 5/2020 Brown ..... A47C 20/12
2020/0187662 A1 * 6/2020 Zeng ..... A47C 19/122
2020/0002144 A1 7/2020 Wang et al.
2020/0214460 A1 * 7/2020 Wang ..... A47C 21/006
2020/0214463 A1 * 7/2020 Xie ..... A47C 20/041
2021/0052085 A1 * 2/2021 Wang ..... A47C 31/005
(Continued)

*Primary Examiner* — Justin C Mikowski
*Assistant Examiner* — Luke Hall
(74) *Attorney, Agent, or Firm* — Wood Herron & Evans LLP

(57) ABSTRACT

An adjustable bed base has a stationary frame and a stationary seat platform raised above the stationary frame. An articulating platform includes at least three platforms, head and foot platforms being hinged to the stationary seat platform. Front and rear linear actuators articulate the deck such that the head and foot platforms decline relative to the stationary seat platform when the linear actuators are fully retracted. The head and foot platforms are inclined when the linear actuators are fully extended.

20 Claims, 11 Drawing Sheets

(56) References Cited

U.S. PATENT DOCUMENTS

| | | | | |
|---|---|---|---|---|
| 2021/0259432 | A1* | 8/2021 | Wang | A47C 20/12 |
| 2022/0061542 | A1* | 3/2022 | Bishop | A47C 20/041 |
| 2022/0160140 | A1* | 5/2022 | Shih | A47C 20/041 |
| 2022/0369822 | A1* | 11/2022 | Ma | A47C 19/122 |
| 2023/0000257 | A1* | 1/2023 | Che | A47C 20/041 |
| 2023/0021490 | A1* | 1/2023 | Jian | A47C 20/041 |
| 2023/0033335 | A1* | 2/2023 | Wang | A47C 19/005 |
| 2023/0200546 | A1* | 6/2023 | Shih | A47C 20/041 5/174 |
| 2023/0200549 | A1* | 6/2023 | Shih | A47C 20/041 5/616 |
| 2023/0200550 | A1* | 6/2023 | Wang | A47C 20/041 5/618 |
| 2023/0309702 | A1* | 10/2023 | Freelend | A47C 20/041 5/618 |

* cited by examiner

ADJUSTABLE BED BASE WITH DECLINE FEATURE ON BOTH ENDS

FIELD OF THE INVENTION

This invention relates generally to bedding products and, more particularly, to a motorized adjustable bed base.

BACKGROUND OF THE INVENTION

Conventional adjustable bed bases often have a stationary frame supported by leg assemblies. Such adjustable bed bases typically include a deck supported by the stationary frame. The deck supports a mattress. The deck usually comprises multiple deck members hinged together. One of the deck members, commonly a seat deck member, is commonly fixedly secured to the stationary frame. A head deck member is typically hinged to the seat deck member. A first motorized linear actuator inclines the front end of the head deck member so a user may sit up and read or watch television in an inclined position.

A leg deck member is commonly hinged to the stationary seat deck member and a foot deck member hinged to the leg deck member. A second motorized linear actuator serves to incline the leg and foot deck members around a person's knees for comfort.

One drawback to such common adjustable bed bases is that the head deck member articulated deck is either horizontal (when the deck members are aligned) or inclined. There is no mechanism to decline the head deck member. Similarly, the thigh deck member is either horizontal (when the deck members are aligned) or inclined. There is no mechanism to decline the thigh deck member.

Persons who sleep on their stomach may desire a curved sleeping surface such that the head and foot ends of the sleeping surface are below the middle portion of the sleeping surface. Other health conditions or situations may require that a person's head and/or feet is below his/her midsection.

In view of the above, there is a need for an adjustable bed base having head and foot platform sections which may be declined as well as inclined relative to a stationary middle platform second. There is further a need for an adjustable bed base which is capable of declining opposite ends of the articulated platform of the adjustable bed base when desired.

It is therefore an objective of this invention to provide an adjustable bed base having head and foot platform section which may be declined relative to a raised middle platform section.

It is further an objective of this invention to provide an adjustable bed base having an articulated platform comprising three pieces, a stationary middle piece being raised relative to a frame.

SUMMARY OF THE INVENTION

According to one aspect of the invention, an adjustable bed base comprises a generally rectangular stationary frame having opposed side rails, a head rail and a foot rail. Legs which may or may not be adjustable in height are secured to the stationary frame for supporting the stationary frame.

The adjustable bed base further comprises a riser secured to the stationary frame. In one embodiment, the riser comprises two cross members secured to the side rails of the stationary frame and extending between the side rails of the stationary frame. This version of riser further comprises stubs extending upwardly from the cross members of the riser and braces extending between the stubs. The braces extend parallel to the side rails of the stationary frame.

In another embodiment, the riser comprises two arched members secured to the side rails of the stationary frame.

The adjustable bed base further comprises an articulated platform comprising a head platform section, a seat platform section and a foot platform section hinged together. The seat platform section is secured to the riser such that the seat platform section is stationary above the stationary frame. In one embodiment, each of the platform sections is a solid member made of either wood or plastic. In other embodiments, each of the platform sections comprises linear segments of metal welded together.

The adjustable bed base further comprises a front pusher assembly for inclining the head platform section. The front pusher assembly comprises two arms. Each of the arms is pivotally secured to one of the side rails of the stationary frame. A wheel is attached to an end of each of the arms. The front pusher assembly further comprises a lower stabilizer extending between the arms and an upper stabilizer extending between the arms. The front pusher assembly further comprises a front linear actuator having a first end pivotally secured to a mounting bracket secured to the lower stabilizer of the front pusher assembly and a second end pivotally secured to a mounting bracket secured to the head rail of the stationary frame.

The adjustable bed base further comprises a rear pusher assembly for inclining the foot platform section. The rear pusher assembly comprises two links. Each of the links is pivotally secured to one of the side rails of the stationary frame. A wheel is attached to an end of each of the links. The rear pusher assembly further comprises a lower stabilizer extending between the links and an upper stabilizer extending between the links. The rear pusher assembly further comprises a rear linear actuator having a first end pivotally secured to a mounting bracket secured to the lower stabilizer of the rear pusher assembly and a second end pivotally secured to a mounting bracket secured to the rear rail of the stationary frame.

The linear actuators are preferably motorized. The articulated deck is generally U-shaped when the linear actuators are retracted. The maximum incline or tilt occurs when the linear actuator is fully extended.

Worded another way, the adjustable bed base comprises a stationary frame having opposed side rails, a head rail and a foot rail. Legs, which may or may not be adjustable in height, support the stationary frame.

The adjustable bed base further comprises a riser secured to the stationary frame.

The adjustable bed base further comprises an articulated platform comprising a stationary seat platform section secured to the riser, a head platform section hinged to one side of the stationary seat platform section and a foot platform section hinged to the other side of the stationary seat platform section. In one embodiment, each of the platform sections is a solid member made of either wood or plastic. In other embodiments, each of the platform sections comprises linear segments of metal welded together.

The adjustable bed base further comprises a front pusher assembly for inclining the head platform section. The front pusher assembly comprises two arms. A wheel is attached to a first end of each of the arms. A second end of each of the arms is pivotally secured to one of the side rails of the stationary frame. The front pusher assembly further comprises a lower stabilizer extending between the arms and an upper stabilizer extending between the arms. The front pusher assembly further comprises a front linear actuator having a first end pivotally secured to a mounting bracket secured to the lower stabilizer of the front pusher assembly and a second end pivotally secured to a mounting bracket secured to the head rail of the stationary frame.

The adjustable bed base further comprises a rear pusher assembly for inclining the foot platform section. The rear pusher assembly comprises two links. Each of the links has a first end to which a wheel is attached and a second end pivotally secured to one of the side rails of the stationary frame. The rear pusher assembly further comprises a lower stabilizer extending between the links and an upper stabilizer extending between the links. The rear pusher assembly further comprises a rear linear actuator having a first end pivotally secured to a mounting bracket secured to the lower stabilizer of the rear pusher assembly and a second end pivotally secured to a mounting bracket secured to the rear rail of the stationary frame.

Worded yet another way, the adjustable bed base comprises a stationary frame having opposed side rails, a head rail and a foot rail. Legs, which may or may not be adjustable in height, support the stationary frame.

The adjustable bed base further comprises a riser secured to the side rails of the stationary frame. The adjustable bed base further comprises a stationary seat platform section secured to the riser, a head platform section hinged to one side of the stationary seat platform section and a foot platform section hinged to the other side of the stationary seat platform section. In one embodiment, each of the platform sections is a solid member made of either wood or plastic. In other embodiments, each of the platform sections comprises linear segments of metal welded together.

The adjustable bed base further comprises a front pusher assembly for inclining the head platform section. The front pusher assembly comprises two arms. A wheel is attached to a first end of each of the arms. A second end of each of the arms is pivotally secured to one of the side rails of the stationary frame. The front pusher assembly further comprises a lower stabilizer extending between the arms. The front pusher assembly further comprises a front linear actuator having a first end pivotally secured to a mounting bracket secured to the lower stabilizer of the front pusher assembly and a second end pivotally secured to a mounting bracket secured to the head rail of the stationary frame.

The adjustable bed base further comprises a rear pusher assembly for inclining the foot platform section. The rear pusher assembly comprises two links. Each of the links has a first end to which a wheel is attached and a second end pivotally secured to one of the side rails of the stationary frame. The rear pusher assembly further comprises a lower stabilizer extending between the links. The rear pusher assembly further comprises a rear linear actuator having a first end pivotally secured to a mounting bracket secured to the lower stabilizer of the rear pusher assembly and a second end pivotally secured to a mounting bracket secured to the rear rail of the stationary frame.

The head and foot platform sections are declined when the front and rear linear actuators are fully retracted or in their home positions.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
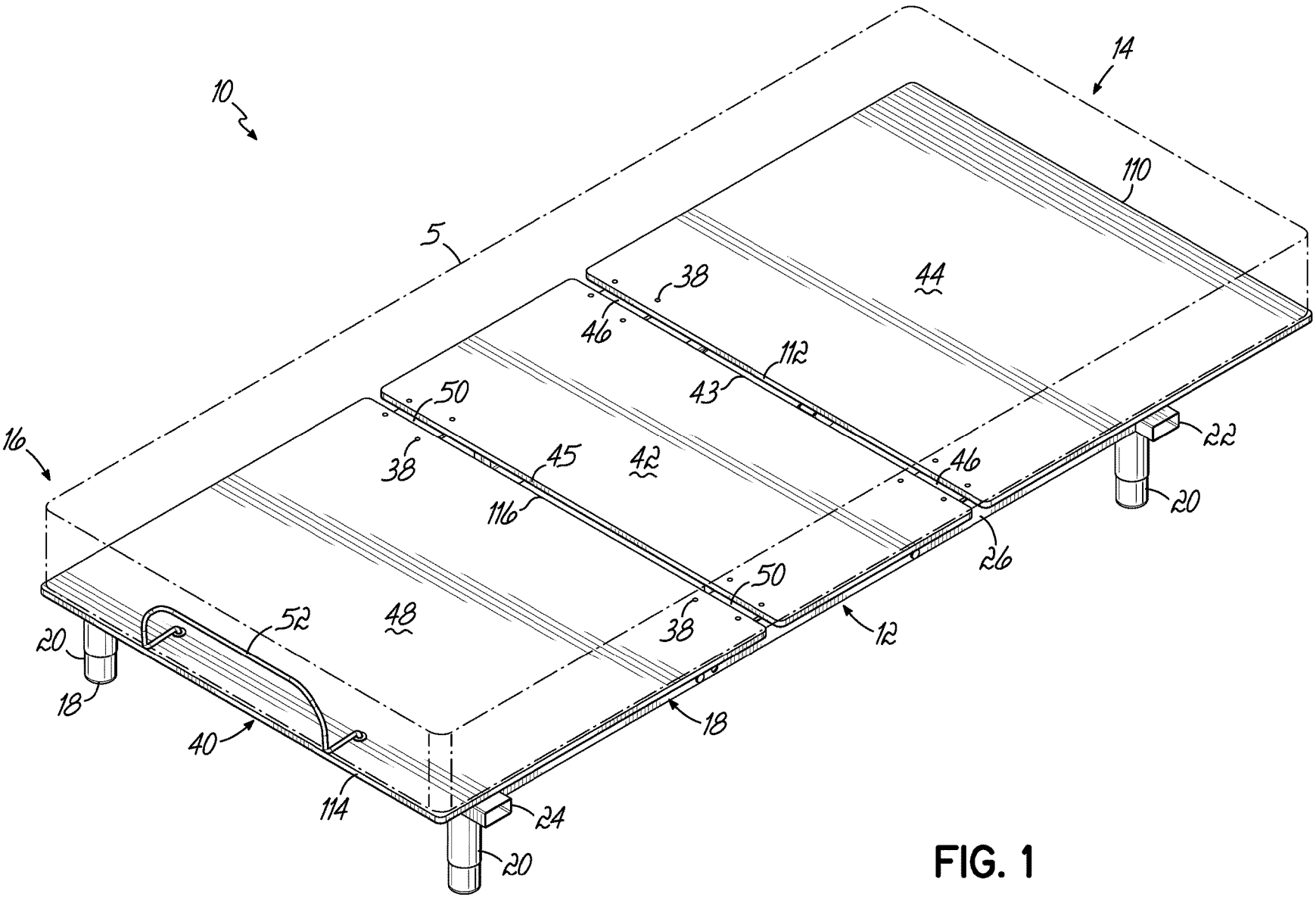
FIG. 1 is a top perspective view of an adjustable bed base.

Referring to FIG. 1, an adjustable bed 10 includes an adjustable bed base 12 for supporting a mattress 5. The adjustable bed base 12 has a head end 14 and a foot end 16. The adjustable bed base 12 of the present invention may be used with any type of mattress. The mattress is not intended to be limited by the drawings.

Figure 2:
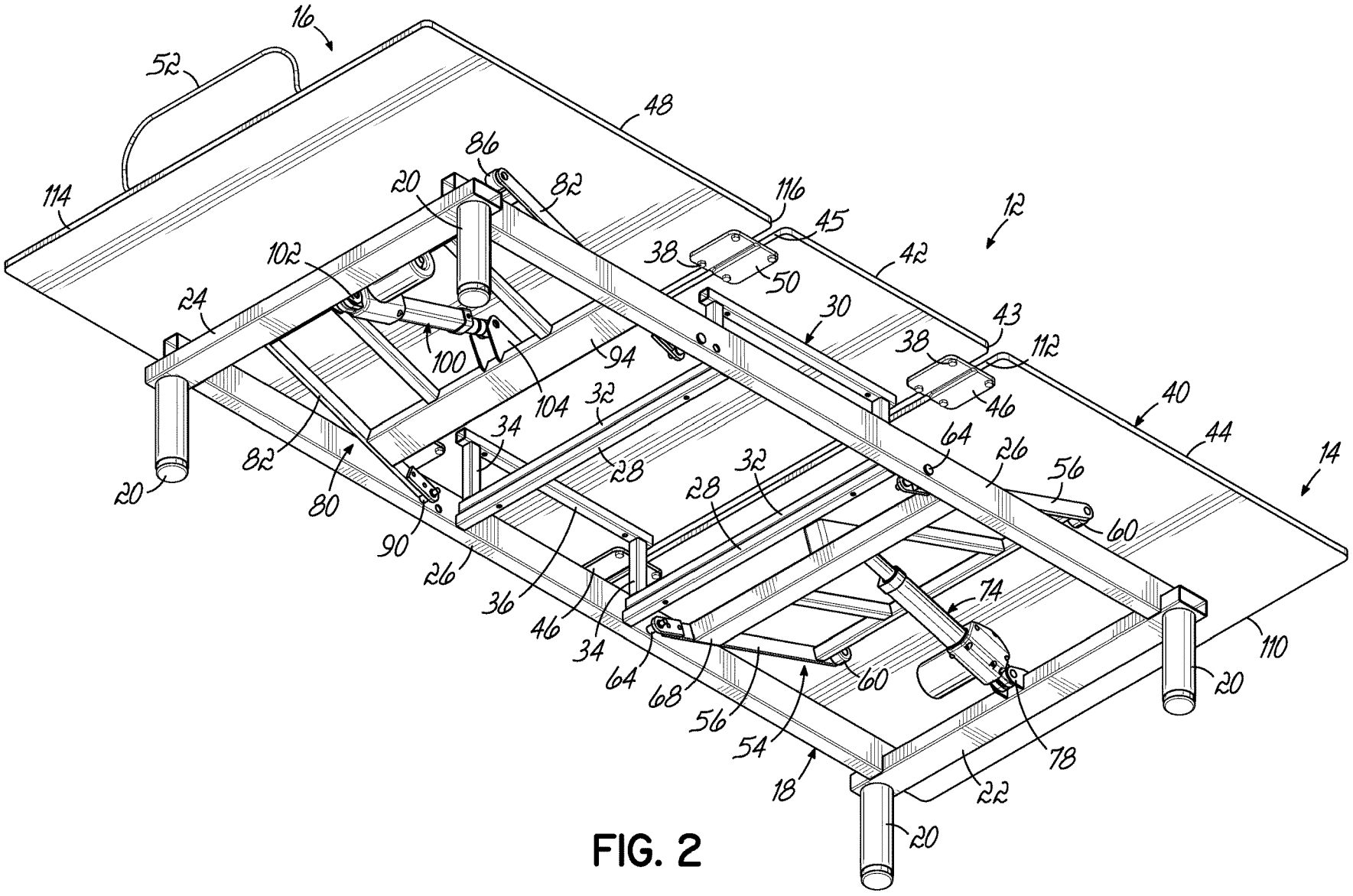
FIG. 2 is a bottom perspective view of the adjustable bed base of FIG. 1.

As best shown in FIG. 2, the adjustable bed base 12 comprises a generally rectangular stationary frame 18 supported by leg assemblies or legs 20. The leg assemblies 20 are illustrated as being adjustable in height. Although one type of leg assembly 20 is illustrated supporting the adjustable bed base 12, any other type of leg assembly including unitary legs not adjustable in height may be used in accordance with the present invention. The legs of the adjustable bed base are not intended to be limited by the drawings.

Figure 4:
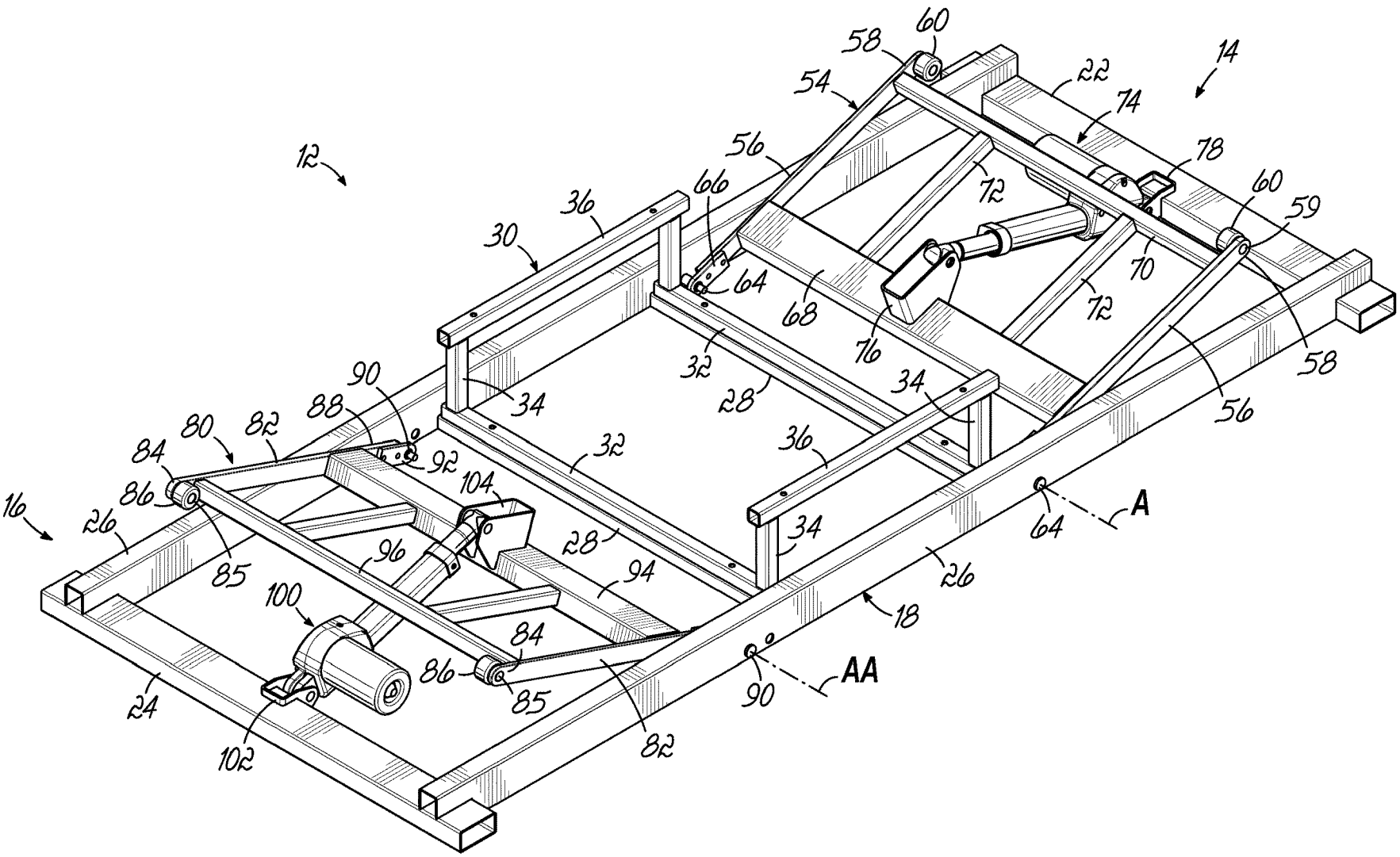
FIG. 4 is an enlarged perspective view of a portion of the adjustable bed base of FIG. 1.

As best shown in FIG. 4, the generally rectangular stationary frame 18 comprises a head rail 22, a foot rail 24 and two opposed side rails 26. The head rail 22 and foot rail 24 each extends between the opposed side rails 26. Although the drawings show the head, foot and side rails 22, 24 and 26, respectively, each having a hollow interior and being a certain size and/or shape, the drawings are not intended to be limiting.

The stationary frame 18 further comprises two cross rails 28 secured to the side rails 26 of the stationary frame 18, each cross rail 28 extending between the side rails 26 of the stationary frame 18. Although the drawings show each of the cross rails 28 having a hollow interior and being a certain size and/or shape, the drawings are not intended to be limiting. Although the stationary frame 18 is typically made of metal, it may be made of any known material.

As best shown in FIG. 4, the adjustable bed base 12 further comprises a riser 30 secured to the stationary frame 18. The riser 30 comprises two cross members 32 secured to the cross rails 28 of the stationary frame 18. The riser 30 further comprises stubs 34 extending upwardly from the cross members 32 of the riser 30. More specifically, two stubs 34 are secured to each of the cross members 32 at opposite ends of the cross member 32. As best shown in FIG. 4, the riser 30 further comprises two braces 36, each of the braces 36 extending between two stubs 34. Each of the braces 36 extends parallel to one of the side rails 26 of the stationary frame 18 and is spaced above the side rail 26 of the stationary frame 18.

As best shown in FIGS. 1 and 2, the adjustable bed base 12 further comprises an articulating platform 40 comprising a seat platform section 42 secured to the braces 36 of the riser 30 with fasteners 38 and does not move when the platform 40 is articulated. See FIGS. 5A-5E. A head platform section 44 is hinged to the seat platform section 42 with hinges 46. Lastly, a foot platform section 48 is hinged to the seat platform section 42 with hinges 50. Although the platform sections 42, 44 and 48 are shown being solid pieces, one or more of them may have openings therethrough. The drawings are not intended to be limiting. Similarly, although the head and foot platform sections 44, 48 are illustrated being approximately the same size, the size of any of the platform sections is not intended to be limited by the drawings.

Although two hinges are shown securing adjacent platform sections, any other number of hinges may be used. The seat platform section 42 has a front edge 43 closest to the head platform section 48 and a rear edge 45 closest to the foot platform section 48.

As best shown in FIG. 1, a stop 52 is secured to the foot platform section 48 of the articulating platform 40 and functions to prevent movement of the mattress 5 relative to the adjustable bed base 12 when the articulating platform 40 is articulated.

Figure 3:
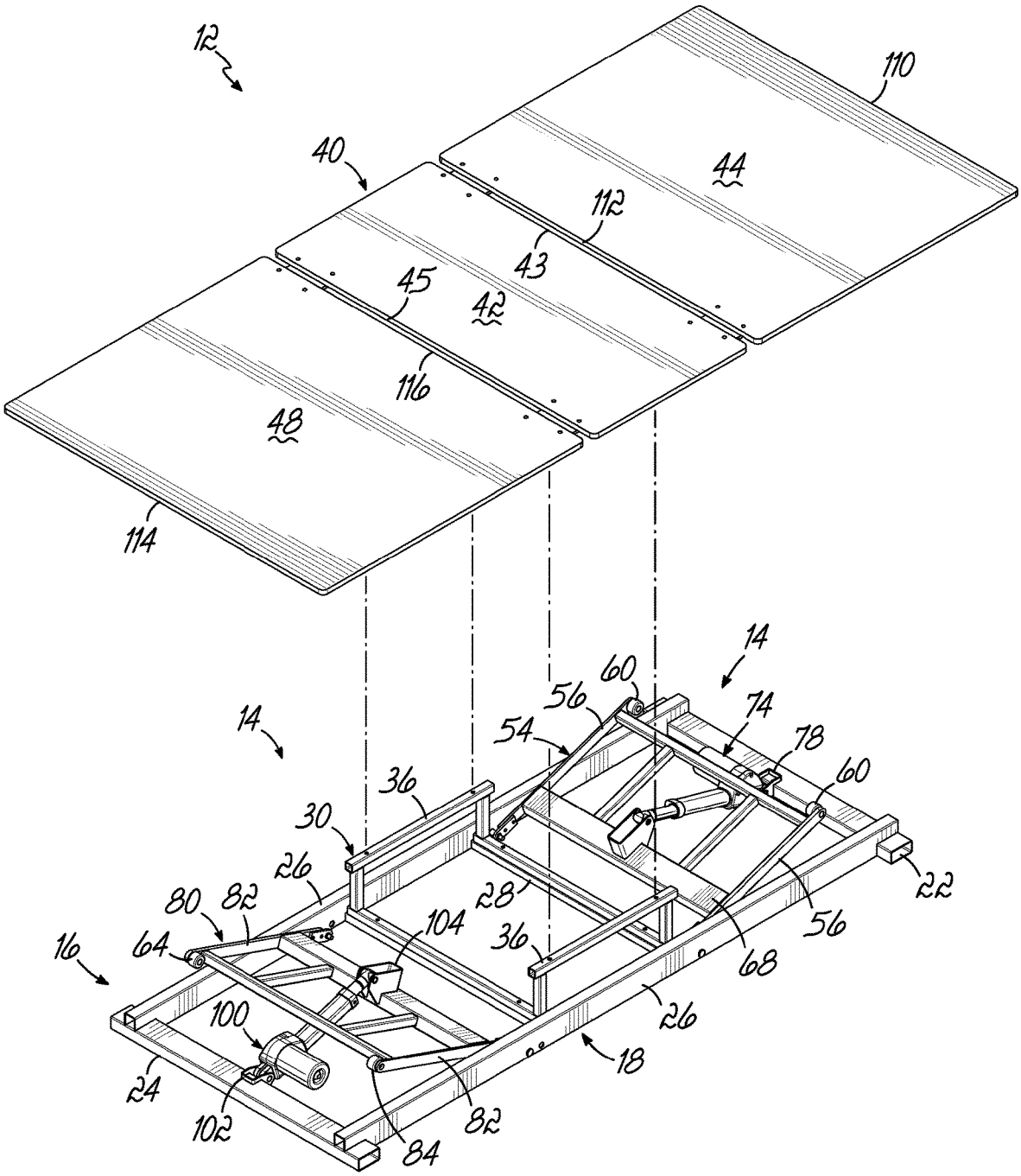
FIG. 3 is perspective view of the adjustable bed base of FIG. 1 showing the articulated platform separated from the remainder of the adjustable bed base.

As best shown in FIGS. 3 and 4, the adjustable bed base 12 further comprises a front pusher assembly 54 for moving the head platform section 44. The front pusher assembly 54 comprises two arms 56. Each of the arms 56 has a first end 58 to which a rotatable wheel 60 is secured with a pin 59. Each of the arms 56 has a second end 62 which is pivotally secured to one of the side rails 26 of the stationary frame 18 with a pin 64 such that the arm pivots about an axis A, as shown in FIG. 4. Each arm 56 may include an arm extension 66 best shown in FIG. 4 or be a unitary member.

As best shown in FIG. 4, the front pusher assembly 54 of the adjustable bed base 12 further comprises a lower stabilizer 68 extending between the arms 56 and an upper stabilizer 70 extending between the arms 56. The upper stabilizer 70 is closer to the wheels 60 than the lower stabilizer 68. The upper and lower stabilizers 70, 68 are each shown as a hollow member but either may be a solid or partially solid member. Two braces 72 extend between the upper and lower stabilizers 70, 68. The braces 72 extend parallel to the arms 56.

As best shown in FIG. 4, the front pusher assembly 54 of the adjustable bed base 12 further comprises a motorized front linear actuator 74 for moving (inclining or declining) the head platform section 44. The motorized front linear actuator 74 has a rear or first end pivotally secured to a mounting bracket 76 secured to the lower stabilizer 68 of the front pusher assembly 54. The motorized front linear actuator 74 has a front or second end pivotally secured to a mounting bracket 78 secured to the head rail 22 of the stationary frame 18. Although the mounting brackets 76, 78 are shown having certain shapes, either mounting bracket may be any other desired shape. Again, the drawings are not intended to be limiting.

As best shown in FIGS. 3 and 4, the adjustable bed base 12 further comprises a rear pusher assembly 80 for moving (inclining or declining) the foot platform section 48. The rear pusher assembly 80 comprises two links 82. Each of the links 82 has a first end 84 to which a rotatable wheel 86 is secured with a pin 85. Each of the links 82 has a second end 88 which is pivotally secured to one of the side rails 26 of the stationary frame 18 with a pin 90 such that the arm pivots about an axis AA, as shown in FIG. 4. Each link 82 may include a link extension 92 best shown in FIG. 4 or be a unitary member.

As best shown in FIG. 4, the rear pusher assembly 80 of the adjustable bed base 12 further comprises a lower stabilizer 94 extending between the links 82 and an upper stabilizer 96 extending between the links 82. The upper stabilizer 96 is closer to the wheels 86 than the lower stabilizer 94. The upper and lower stabilizers 96, 94 are each shown as a hollow member but either may be a solid or partially solid member. Two braces 98 extend between the upper and lower stabilizers 96, 94. The braces 98 extend parallel to the links 82.

As best shown in FIG. 4, the rear pusher assembly 80 of the adjustable bed base 12 further comprises a motorized rear linear actuator 100 for inclining the foot platform section 48. The motorized rear linear actuator 100 has a rear or first end pivotally secured to a mounting bracket 102 secured to the rear rail 24 of the stationary frame 18. The motorized rear linear actuator 100 has a front or second end pivotally secured to a mounting bracket 104 secured to the lower stabilizer 94 of the rear pusher assembly 80. Although the mounting brackets 102, 104 are shown having certain shapes, either mounting bracket may be any other desired shape. Again, the drawings are not intended to be limiting.

Figure 5A:
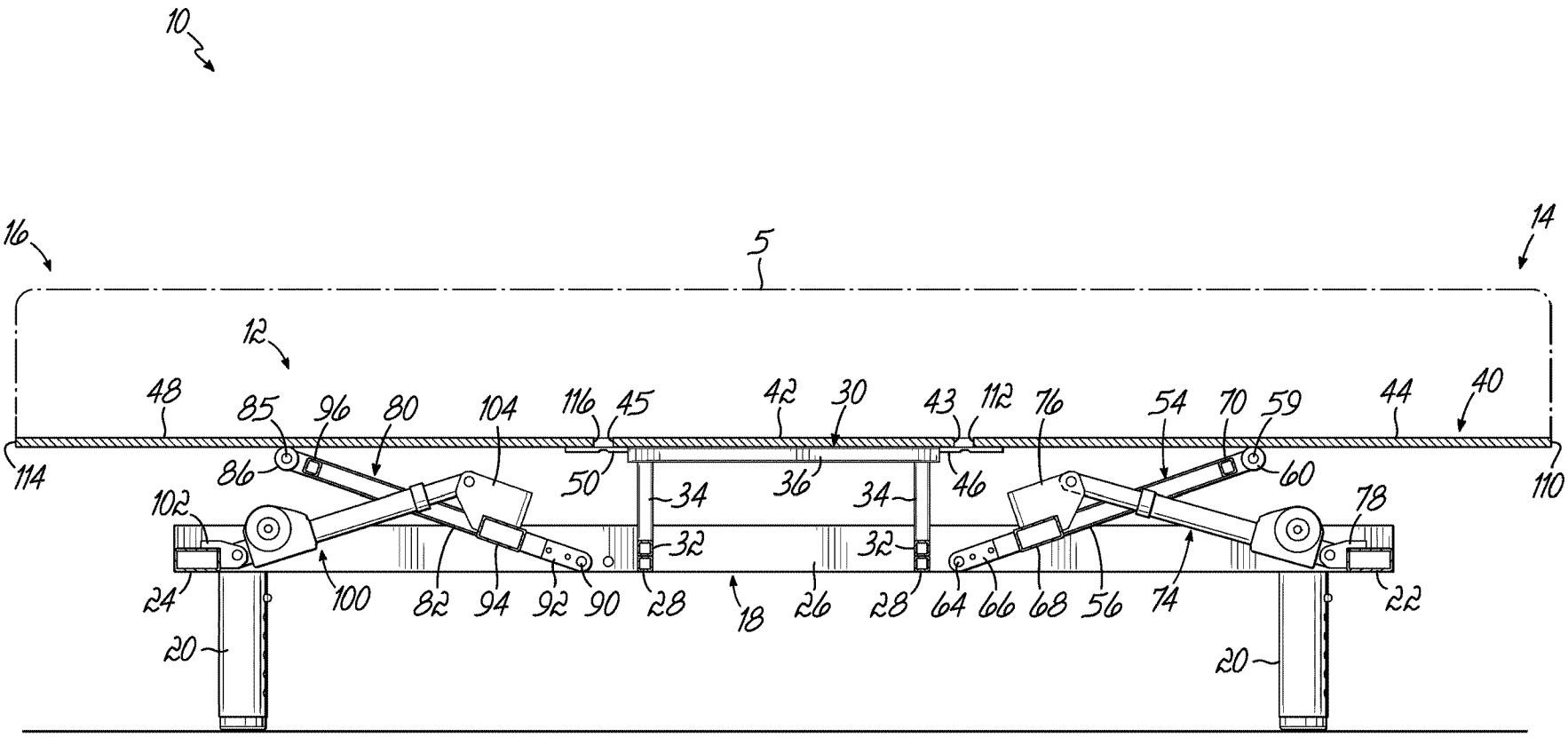
FIG. 5A is a side view, partially in cross-section, of the adjustable bed base of FIG. 1 in a home position.
Figure 5B:
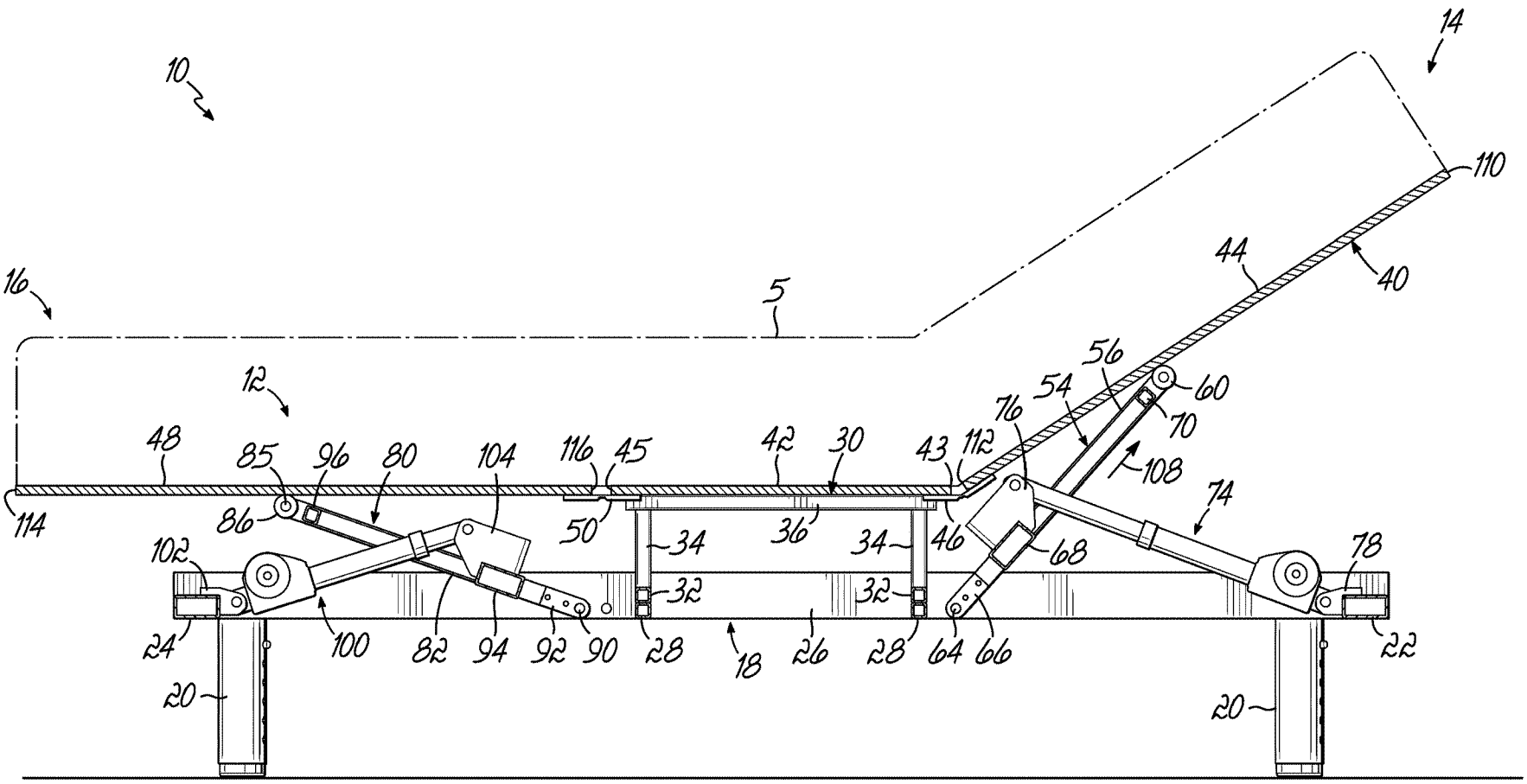
FIG. 5B is a side view, partially in cross-section, of the adjustable bed base of FIG. 1 showing the head platform section in an inclined position and the foot platform section in its home position.

FIGS. 5A-5E show different positions of the adjustable bed base 12, due to the positions of the motorized front and rear linear actuators 74, 100. FIG. 5A shows the articulating platform 40 being flat with the platform sections 42, 44 and 48 being co-planar. FIG. 5A shows the adjustable bed base 12 in a home position with the platform sections 42, 44 and 48 being in a horizontal position. In this home position, the motorized front and rear linear actuators 74, 100 are each partially retracted but not fully retracted. From this home position shown in FIG. 5A, the motorized front linear actuator 74 of adjustable bed base 12 is activated via remote control (not shown) or an app on a phone (not shown) to expand or lengthen. Such expansion of the motorized front linear actuator 74, shown by arrow 108 in FIG. 5B, inclines the front platform section 44 such that a front edge 110 of the front platform section 44 is above a rear edge 112 of the front platform section 44. This expansion of the motorized front linear actuator 74 pivots the front pusher assembly 54 about pivot axis A causing upward movement of the wheels 60 along the bottom surface of the front platform section 44 which raises the front edge 110 of the front platform section 44 and moves the front platform section 44 to its fully inclined position shown in FIG. 5B. This forward movement of the wheels 60 causes the front platform section 44 to rise upwardly, thereby to its fully inclined position shown in FIG. 5B. FIG. 5B shows the foot platform section 48 in a flat position and the front platform section 44 in its fully inclined position due to full extension of the motorized front linear actuator 74.

Figure 5C:
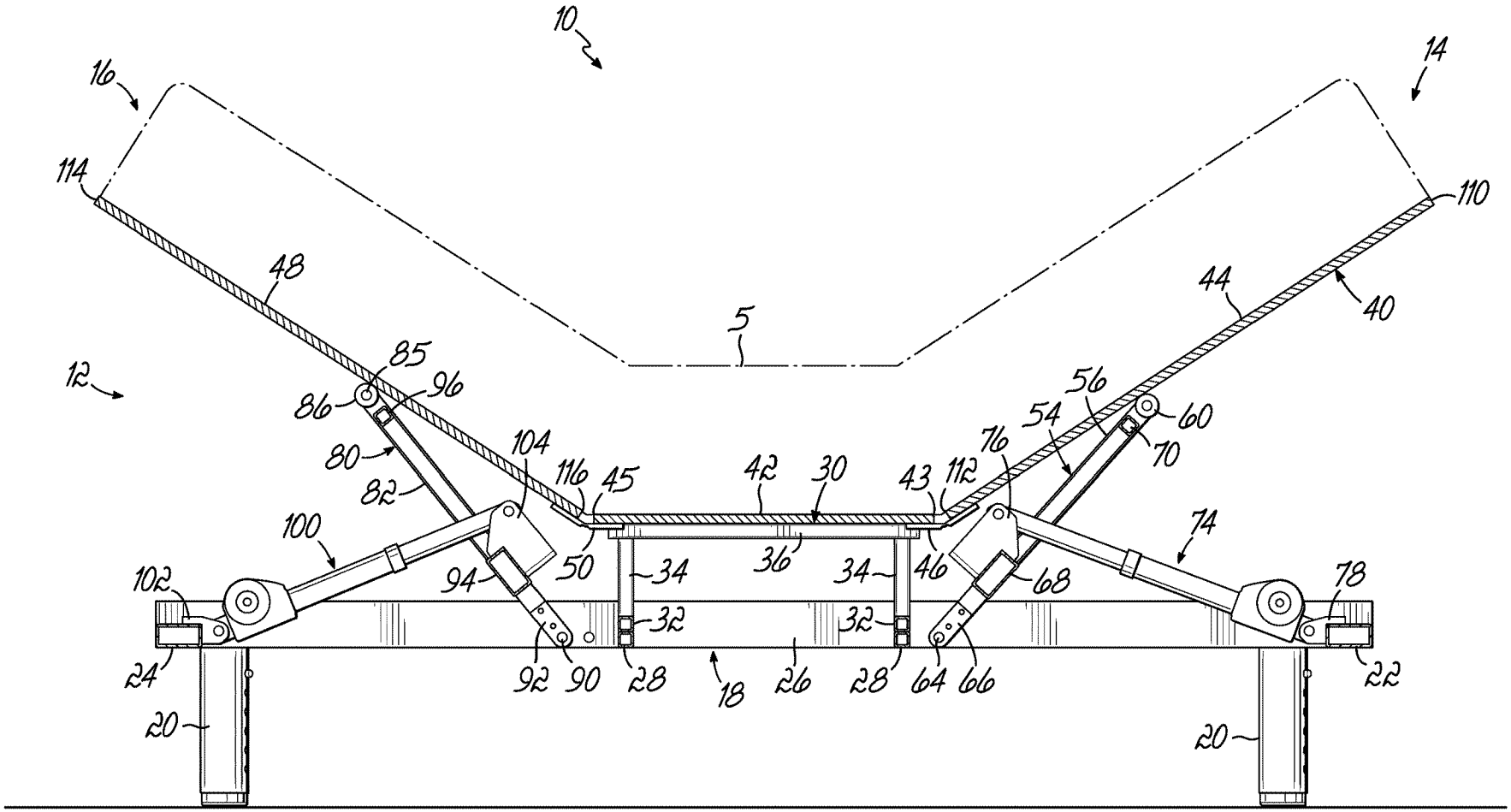
FIG. 5C is a side view, partially in cross-section, of the adjustable bed base of FIG. 1 showing the head and foot platform sections in their inclined positions.

FIG. 5C shows the adjustable bed base 12 in a position with the head platform section 44 in its fully inclined position like FIG. 5B. FIG. 5C also shows the foot platform section 48 in its fully inclined position due to full extension of the rear linear actuator 80. From its home position shown in FIG. 5B, the motorized rear linear actuator 80 of adjustable bed base 12 is activated via remote control (not shown) or phone app (not shown) to expand or lengthen. Such expansion of the motorized rear linear actuator 80, causes the rear pusher assembly 80 to pivot about axis AA to a fully inclined position. This pivotal movement of the rear pusher assembly 80 causes the wheels 86 of the rear pusher assembly 80 to move upwardly along the underside of the foot platform section 48, thereby raising a rear edge 114 of the foot platform section 48 above a front edge 116 of the foot platform section 48. When the adjustable bed base is in the position shown in FIG. 5C with both motorized linear actuators 74, 100 fully extended, the articulating platform 40 assumes a generally U-shape.

Figure 5D:
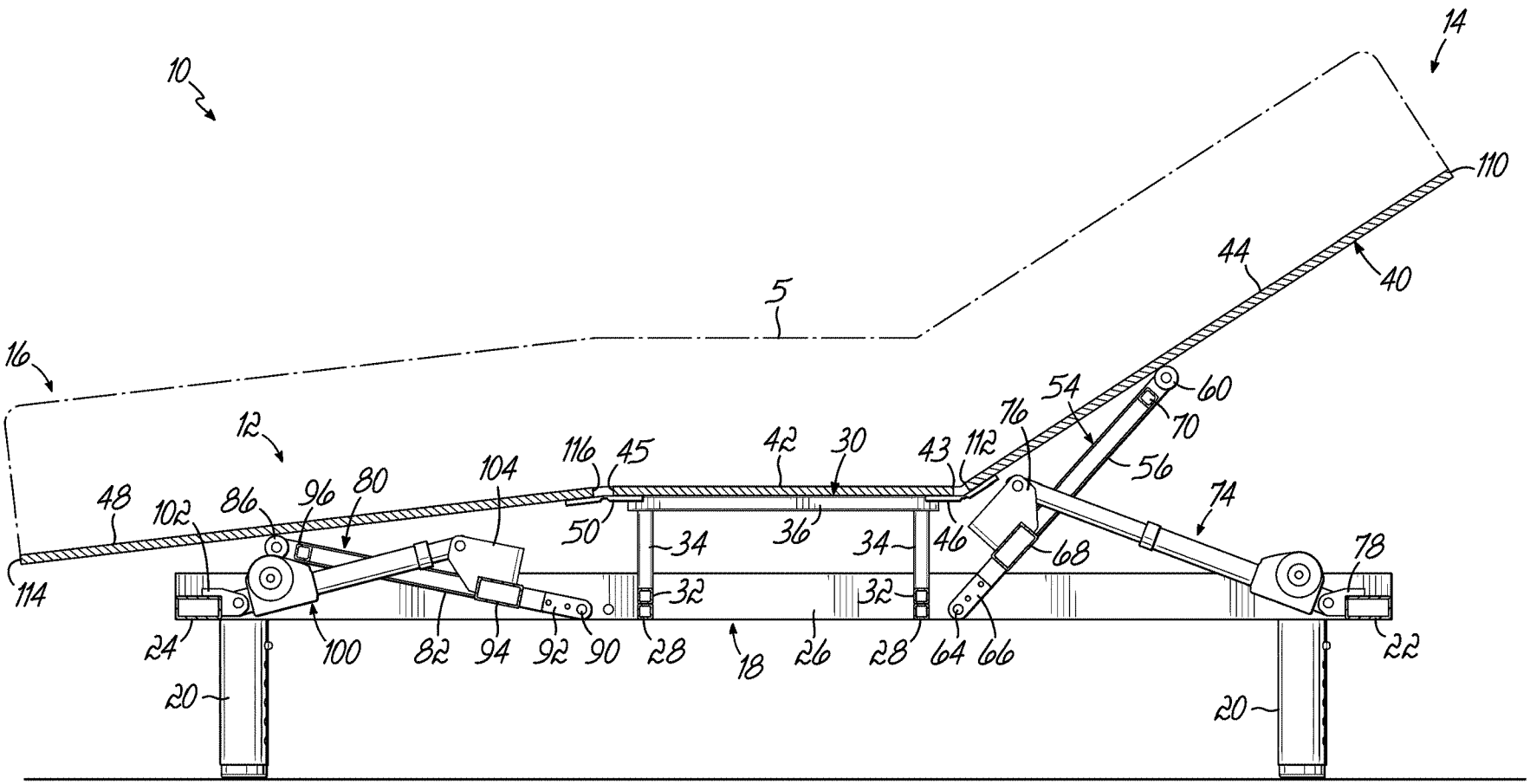
FIG. 5D is a side view, partially in cross-section, of the adjustable bed base of FIG. 1 showing the head platform section in an inclined position and the foot platform section in a declined position.

FIG. 5D shows the adjustable bed base 12 in a position with the front platform section 44 in its fully inclined position like FIG. 5C. FIG. 5D shows the foot platform section 48 in its fully declined position due to full retraction of the motorized rear linear actuator 100. From its home position shown in FIG. 5B, the rear linear actuator 80 of adjustable bed base 12 is activated via remote control (not shown) or phone app (not shown) to contract or shorten. Such contraction of the motorized rear linear actuator 80, causes the rear pusher assembly 80 to pivot about axis AA to a fully declined position. This pivotal movement of the rear pusher assembly 80 causes the wheels 86 of the rear pusher assembly 80 to move downwardly along the underside of the foot platform section 48, thereby lowering a rear edge 114 of the foot platform section 48 below a front edge 116 of the foot platform section 48.

Figure 5E:
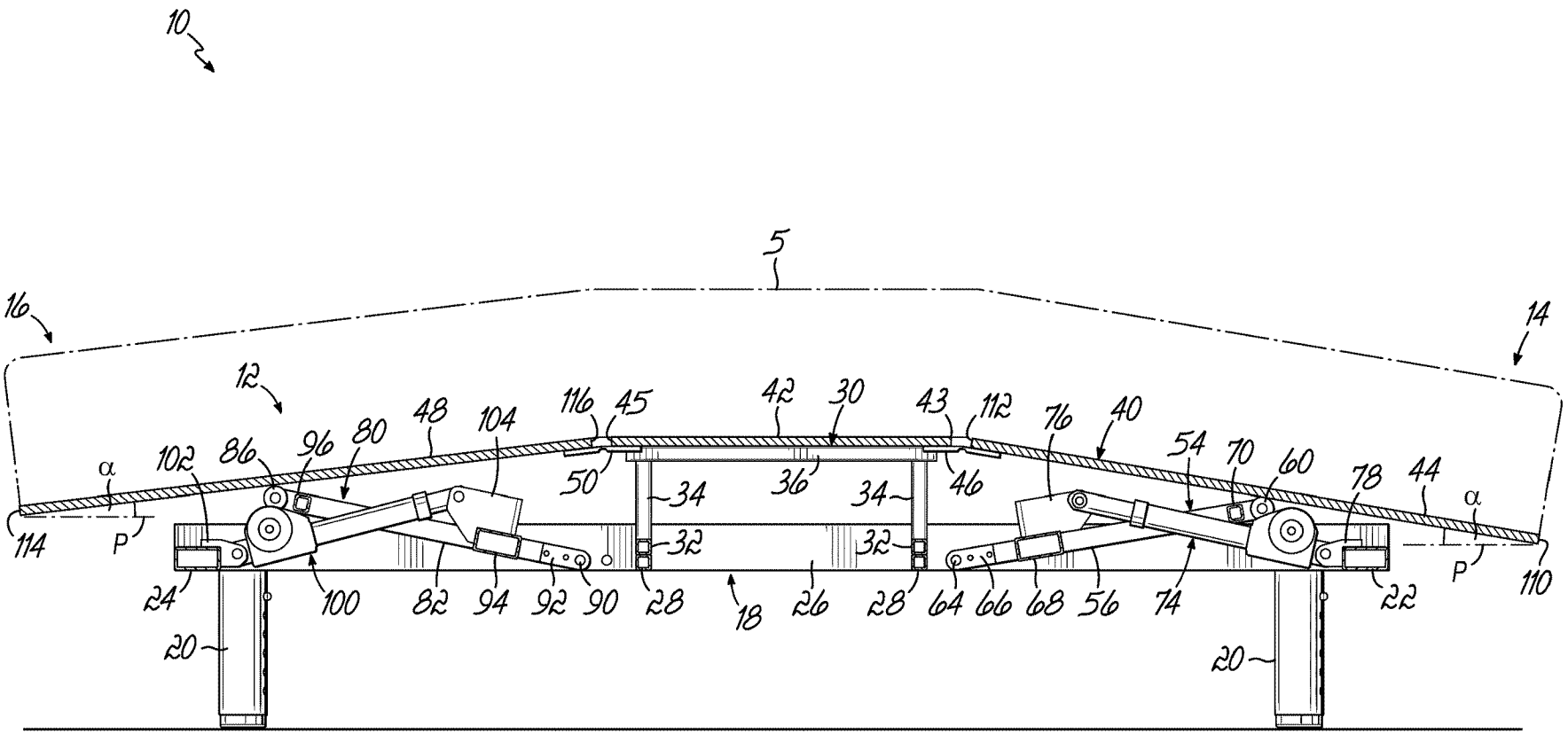
FIG. 5E is a side view, partially in cross-section, of the adjustable bed base of FIG. 1 showing the head platform section in a declined position and the foot platform section in a declined position.

FIG. 5E shows the adjustable bed base 12 in a position with the foot platform section 48 in its fully declined position like FIG. 5D. FIG. 5E shows the head platform section 44 in its fully declined position due to full retraction of the front linear actuator 80. From its home position shown in FIG. 5B, the front linear actuator 80 of adjustable bed base 12 is activated via remote control (not shown) or phone app (not shown) to contract or shorten. Such contraction of the front linear actuator 80, causes the front pusher assembly 54 to pivot about axis A to a fully declined position. This pivotal movement of the front pusher assembly 54 causes the wheels 60 of the front pusher assembly 54 to move downwardly, thereby lowering the front edge 110 of the head platform section 44 below the rear edge 112 of the head platform section 44.

When the adjustable bed base 12 is in this "down" position shown in FIG. 5E, the articulating platform 40 is in a generally inverted U-shaped configuration. In this inverted U-shaped configuration, the outer edges 110, 114 of the articulating platform 40 are generally co-planar in a plane P, the head and foot platform sections 44, 48 each being declined at an angle at an angle θ which may be up to six degrees relative to horizontal.

Figure 6:
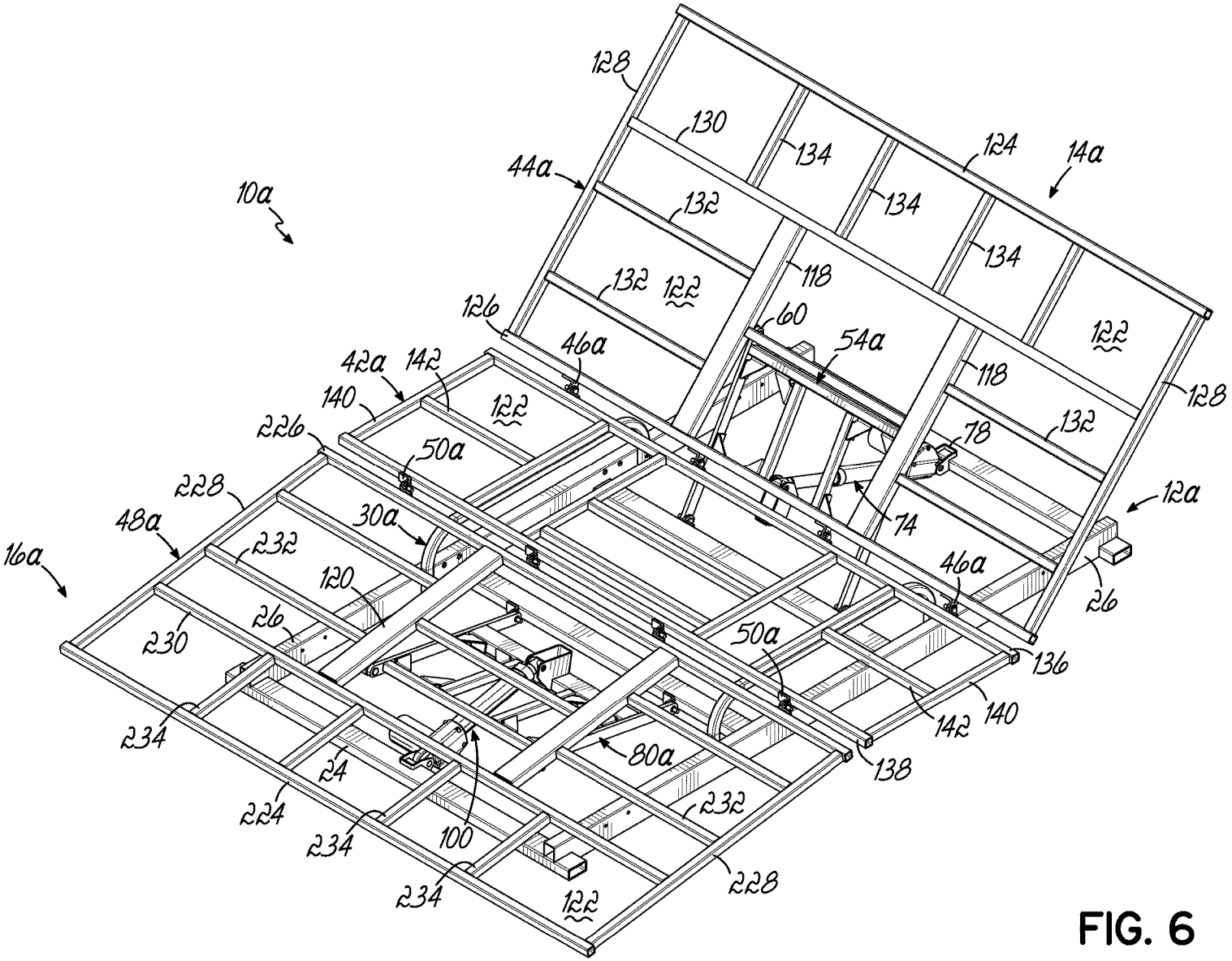
FIG. 6 is a top perspective view of an alternative embodiment of adjustable bed base.
Figure 7:
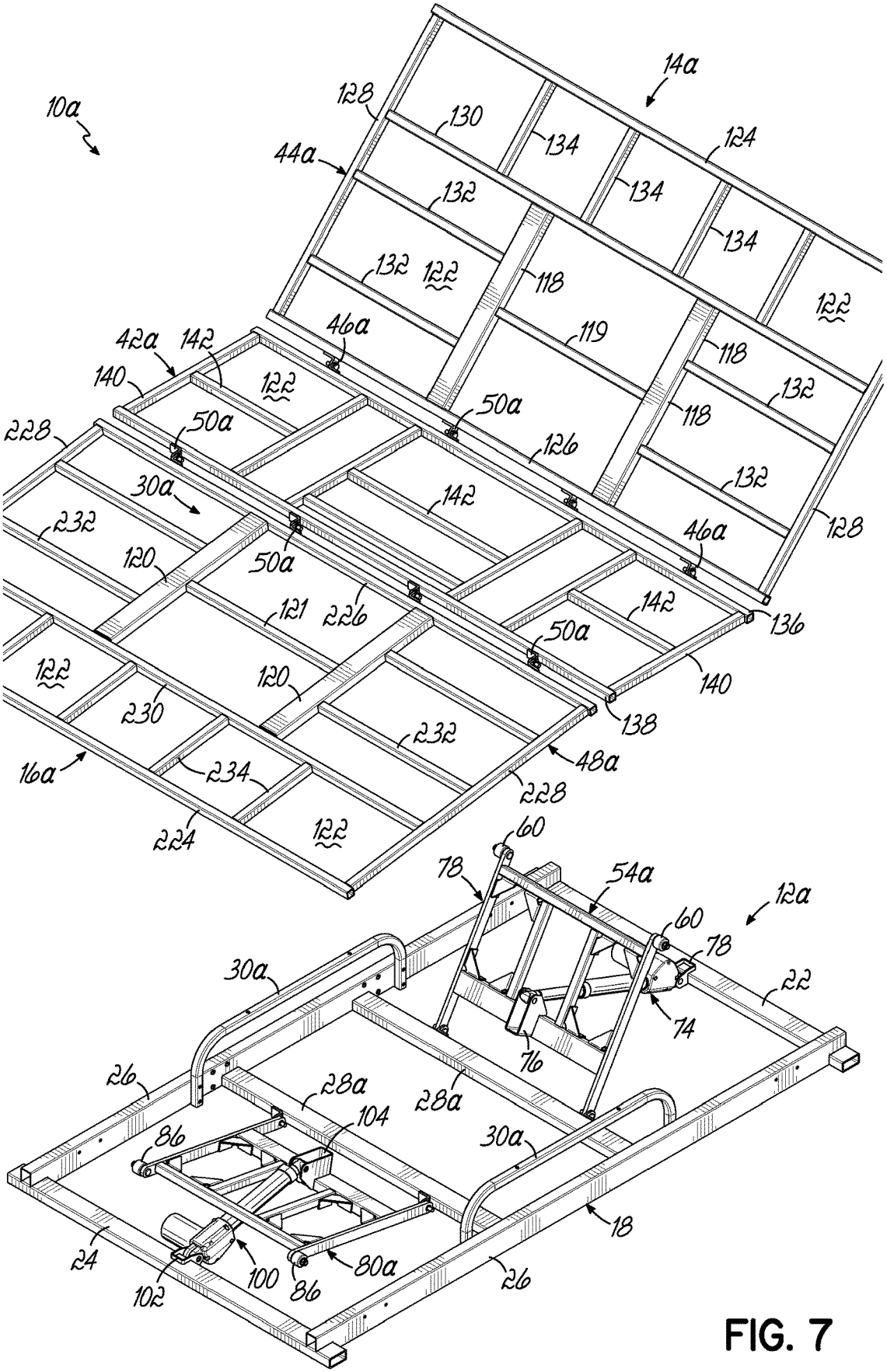
FIG. 7 is perspective view of the adjustable bed base of FIG. 6 showing the articulated platform separated from the remainder of the adjustable bed base.

FIGS. 6 and 7 illustrate a different embodiment of adjustable bed 10*a*. For simplicity, like parts have like numbers but with an "a" designation. The adjustable bed 10*a* comprises an adjustable bed base 12*a* for supporting a mattress 5. The adjustable bed base 12*a* has a head end 14*a* and a foot end 16*a*. The adjustable bed base 12*a* may be used with any type of mattress (not shown).

The adjustable bed base 12*a* has a stationary frame 12*a* similar to stationary frame 12 described above. One principal difference in the stationary frame 12*a* compared to the stationary frame 12 is that the cross rails 28*a* are larger than cross rails 28.

The adjustable bed base 12*a* *has* two risers 30*a*, each being an arcuate or curved member(s) secured to one of the side rails 26 of stationary frame 12*a*. Each riser 30*a* may be made of any number of pieces joined together in any known manner including welding.

The adjustable bed base 12*a* has a front pusher assembly 54*a* similar to the front pusher assembly 54 described above. The principal difference between the front pusher assembly 54*a* compared to the front pusher assembly 54 is that the wheels 60 of front pusher assembly 54*a* are outside, rather than inside of the arms 56. The motorized front linear actuator 74 and associated mounting brackets 78, 76 are the same.

The adjustable bed base 12*a* has a rear pusher assembly 80*a* similar to the rear pusher assembly 80 described above. The principal difference between the rear pusher assembly 80*a* compared to the rear pusher assembly 80 is that the wheels 68 of rear pusher assembly 80*a* are outside, rather than inside of the links 82. The motorized rear linear actuator 100 and associated mounting brackets 102, 104 are the same.

The adjustable bed base 12*a* further comprises an articulating platform 40*a* comprising a seat platform section 42*a* secured to the risers 30*a* and does not move when the platform 40*a* is articulated. See FIG. 6. A head platform section 44*a* is hinged to the seat platform section 42*a* with hinges 46*a*. Lastly, a foot platform section 48*a* is hinged to the seat platform section 42*a* with hinges 50*a*. Although four hinges are shown securing adjacent platform sections, any other number of hinges may be used.

The head platform section 44*a* has two ramps 118 on which the wheels 60 of the front pusher assembly 54*a* ride to move the head platform section 44*a* relative to the stationary seat platform section 42*a*. Similarly, the foot platform section 48*a* has two ramps 120 on which the wheels 68 of the rear pusher assembly 80*a* ride to move the foot platform section 48*a* relative to the stationary seat platform section 42*a*.

The head platform section 44*a* is not a solid member but rather a plurality of metal segments or pieces welded or otherwise joined together with gaps 122 therebetween. The segments include outer perimeter segment 124, inner perimeter segment 126 and side perimeter segments 128 which together define the size of the head platform section 44*a*. The hinges 46*a* are secured to the inner perimeter segment 126 of the head platform section 44*a* and to the head perimeter segment 136 of the seat platform section 42*a* described below. The ramps 118 are parallel to the side perimeter segments 128 and extend between an intermediate segment 130 and the inner perimeter segment 126. A ramp segment 119 extends between the ramps 118. Additional segments 132 extend between one of the ramps 118 and one of the side perimeter segments 128. Secondary segments 134 extend between the outer perimeter segment 124 and the intermediate segment 130.

The seat platform section 42*a* is not a solid member but rather a plurality of metal segments or pieces welded or otherwise joined together with gaps 122 therebetween. The segments include a head perimeter segment 136, a foot perimeter segment 138 and side perimeter segments 140 which together define the size of the seat platform section 42*a*. The hinges 46*a* are secured to the head perimeter segment 136. The seat platform section 42*a* further comprises interior segments 142 arranged in one pattern but not intended to be limited to the pattern shown.

The foot platform section 48*a* is not a solid member but rather a plurality of metal segments or pieces welded or otherwise joined together with gaps 122 therebetween. The segments include outer perimeter segment 224, inner perimeter segment 226 and side perimeter segments 228 which together define the size of the foot platform section 48*a*. The hinges 50*a* are secured to the inner perimeter segment 226 of the foot platform section 48*a* and to the foot perimeter segment 138 of the seat platform section 42*a* described above. The ramps 120 are parallel to the side perimeter segments 228 and extend between an intermediate segment 230 and the inner perimeter segment 226. A ramp segment 121 extends between ramps 120. Additional segments 232 extend between one of the ramps 120 and one of the side perimeter segments 228. Secondary segments 234 extend between the outer perimeter segment 224 and the intermediate segment 230.

Any of the platform segment patterns shown are not intended to be limiting for any of the platform segments, as long as the weight of the platform segments is reduced while still maintaining the requisite strength of the platform segment.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a generally rectangular stationary frame having opposed side rails, a head rail, and a foot rail;

a riser secured to the stationary frame, an articulating platform comprising a head platform section, a seat platform section and a foot platform section hinged together, the seat platform section being secured to the riser such that the seat platform section is stationary above the stationary frame;

a front pusher assembly for inclining the head platform section, the front pusher assembly comprising two arms, a wheel attached to an end of each of the arms, each of the arms being pivotally secured to one of the side rails of the stationary frame, the front pusher assembly further comprising a lower stabilizer extending between the arms, an upper stabilizer extending between the arms and a front linear actuator having a first end pivotally secured to a mounting bracket secured to the lower stabilizer of the front pusher assembly and a second end pivotally secured to a mounting bracket secured to the head rail of the stationary frame;

a rear pusher assembly for inclining the foot platform section, the rear pusher assembly comprising two links, each of the links being pivotally secured to one of the side rails of the stationary frame, the rear pusher assembly further comprising a lower stabilizer extending between the links, an upper stabilizer extending between the links and a rear linear actuator having a first end pivotally secured to a mounting bracket secured to the lower stabilizer of the rear pusher assembly and a second end pivotally secured to a mounting bracket secured to the foot rail of the stationary frame, wherein a front edge of the head platform section is below a rear edge of the head platform section when the front linear actuator is fully retracted and a rear edge of the foot platform section is below a front edge of the foot platform section when the rear linear actuator is fully retracted.

2. The adjustable bed base of claim 1, wherein the riser comprising two cross members secured to the stationary frame, stubs extending upwardly from the cross members of the riser and braces extending between the stubs, the braces extending parallel the side rails of the stationary frame.

3. The adjustable bed base of claim 1, wherein the riser comprises two arched members secured to the side rails of the stationary frame.

4. The adjustable bed base of claim 1, wherein the linear actuators are motorized.

5. The adjustable bed base of claim 1, wherein at least one of the platform sections is a solid member.

6. The adjustable bed base of claim 1, wherein at least one of the platform sections comprises multiple linear segments joined together.

7. The adjustable bed base of claim 1, wherein the head and foot platform sections are inclined when the front and rear linear actuators are fully extended.

8. The adjustable bed base of claim 1, wherein the head and foot platform sections are declined when the front and rear linear actuators are fully retracted.

9. An adjustable bed base comprising:

a stationary frame having opposed side rails, a head rail, and a foot rail;

a riser secured to the stationary frame, an articulating platform comprising a stationary seat platform section secured to the riser, a head platform section hinged to one side of the stationary seat platform section and a foot platform section hinged to the opposite side of the stationary seat platform section;

a front pusher assembly for inclining the head platform section, the front pusher assembly comprising two arms, a wheel attached to a first end of each of the arms, a second end of each of the arms being pivotally secured to one of the side rails of the stationary frame, the front pusher assembly further comprising a lower stabilizer extending between the arms, an upper stabilizer extending between the arms and a front linear actuator having a first end pivotally secured to a mounting bracket secured to the lower stabilizer of the front pusher assembly and a second end pivotally secured to a mounting bracket secured to the head rail of the stationary frame;

a rear pusher assembly for inclining the foot platform section, the rear pusher assembly comprising two links, each of the links having a first end to which a wheel is attached and a second end pivotally secured to one of the side rails of the stationary frame, the rear front pusher assembly further comprising a lower stabilizer extending between the links, an upper stabilizer extending between the links and a rear linear actuator having a first end pivotally secured to a mounting bracket secured to the lower stabilizer of the rear pusher assembly and a second end pivotally secured to a mounting bracket secured to the foot rail of the stationary frame, wherein the head and foot platform sections are declined when the front and rear linear actuators are fully retracted.

10. The adjustable bed base of claim 9, further comprising legs secured to the stationary frame for supporting the stationary frame.

11. The adjustable bed base of claim 9, wherein the linear actuators are motorized.

12. The adjustable bed base of claim 11, wherein the wheels of the front pusher assembly move along the head platform section when the head platform section is pivoted about a head axis.

13. The adjustable bed base of claim 9, wherein the wheels of the rear pusher assembly move along the foot platform section when the foot platform section is pivoted about a foot axis.

14. The adjustable bed base of claim 9, wherein the head platform section is inclined when the front linear actuator is extended.

15. The adjustable bed base of claim 9, wherein the foot platform section is inclined when the rear linear actuator is extended.

16. An adjustable bed base comprising:

a stationary frame having opposed side rails, a head rail, and a foot rail;

a riser secured to the side rails of the stationary frame, a stationary seat platform section secured to the riser, a head platform section hinged to one side of the stationary seat platform section and a foot platform section hinged to the opposite side of the stationary seat platform section;

a front pusher assembly for inclining the head platform section, the front pusher assembly comprising two arms, each arm having a first end to which a wheel is attached and a second end, the second end of each of the arms being pivotally secured to the stationary frame, the front pusher assembly further comprising a lower stabilizer extending between the arms, and a front linear actuator having a first end pivotally secured to a mounting bracket secured to the lower stabilizer of the front pusher assembly and a second end pivotally secured to a mounting bracket secured to the head rail of the stationary frame;

a rear pusher assembly for inclining the foot platform section, the rear pusher assembly comprising two links, each of the links having a first end to which a wheel is attached and a second end, the second end of each of the links being pivotally secured to one of the side rails of the stationary frame, the rear pusher assembly further comprising a lower stabilizer extending between the links, a rear linear actuator having a first end pivotally secured to a mounting bracket secured to the lower stabilizer of the rear pusher assembly and a second end pivotally secured to a mounting bracket secured to the foot rail of the stationary frame, wherein the head and foot platform sections are declined when the front and rear linear actuators are fully retracted.

17. The adjustable bed base of claim 16, further comprising legs secured to the stationary frame for supporting the stationary frame.

18. The adjustable bed base of claim 17, wherein the wheels of the front pusher assembly move along the head platform section when the head platform section is pivoted about a head axis by the front linear actuator.

19. The adjustable bed base of claim 16, wherein the wheels of the rear pusher assembly move along the foot platform section when the foot platform section is pivoted about a foot axis by the rear linear actuator.

20. The adjustable bed base of claim 16, wherein the head platform section is inclined when the front linear actuator is extended.

* * * * *